United States Patent [19]

Foreman

[11] Patent Number: 4,637,615

[45] Date of Patent: Jan. 20, 1987

[54] HOLDER FOR SHOTGUN PATTERN PAPER

[76] Inventor: Howard R. Foreman, Rte. 1, Box 110A, Miami, Okla. 74354

[21] Appl. No.: 759,332

[22] Filed: Jul. 26, 1985

[51] Int. Cl.[4] ..... F41J 1/10

[52] U.S. Cl. ..... 273/407; 403/170

[58] Field of Search ..... 273/407; 40/610; 403/169, 170, 397

[56] References Cited

U.S. PATENT DOCUMENTS

| | | | |
|---|---|---|---|
| 1,364,010 | 12/1920 | Tyerman | 273/407 |
| 2,059,996 | 11/1936 | Goldberg | 40/610 |
| 2,890,051 | 6/1959 | Williams | 273/407 |
| 2,968,850 | 1/1961 | Tinnerman | 403/397 |
| 3,080,166 | 3/1963 | Clark | 273/407 |
| 3,094,802 | 6/1963 | Perry | 40/610 |
| 3,601,353 | 8/1971 | Dale | 273/407 |
| 4,102,587 | 7/1978 | Herb et al. | 403/397 X |
| 4,309,120 | 1/1982 | Werthman | 403/397 |
| 4,323,251 | 4/1982 | Loveland | 273/407 |

FOREIGN PATENT DOCUMENTS

| | | | |
|---|---|---|---|
| 1173027 | 10/1958 | France | 403/170 |
| 1389448 | 4/1975 | United Kingdom | 403/397 |
| 2126309 | 3/1984 | United Kingdom | 403/397 |

*Primary Examiner*—Paul E. Shapiro

*Attorney, Agent, or Firm*—Head, Johnson & Stevenson

[57] ABSTRACT

This is a holder for shotgun pattern paper. The shot pattern of a shotgun is most important to a hunter. This invention provides a way to determine that pattern for any shotgun. A three-part circular or four-part square holder is supported above the ground by two spaced apart support members. The parts are held together by unique clamp. Clips are provided about the periphery of the square or circular ring for holding paper. A shotgun is then fired at the paper from the selected distance and the pattern of the shot can be seen on the paper.

10 Claims, 10 Drawing Figures

HOLDER FOR SHOTGUN PATTERN PAPER

BACKGROUND OF THE INVENTION

This relates to an apparatus for determining the shot pattern of a shotgun. The pattern which the shots of a shotgun make is most important to a hunter. The pattern for a particular shotgun can mean the differnce between either hitting or missing the target. It is important to know the shot pattern for the particular shot and load to be used by the hunter for a particular gun.

SUMMARY OF THE INVENTION

This invention is for a holder for shotgun pattern paper. It includes a circular ring in three pieces or a square member in four pieces and two end support members for either the ring or square. The device can be taken apart and can be stored in a compact arrangement taking very little room.

In one embodiment, the holder includes a ring of two upper and one lower sections or loops each in the form of arcs of less than 180°. Each upper loop has an upper end and a lower end, and the lower loop has a hook at each end. Clamp means are provided to connect the two upper portions together. Special clamp means are provided to clamp each end of the lower section to the unclamped end of the upper two sections. These lower special clamping means are also provided with means for receiving two bars or support legs which extend outwardly from the ring to form a support from the ground in the shape of an isosceles triangle. These special lower clamps will be described later and are such that they hold the support legs and the ring rigidly together.

There are paper clipping means secured to the assembled ring onto which the target or pattern sheet may be hung. After the target paper has been hung, a shotgun is fired at the target from a selected distance and the holes in the paper form the shot pattern for that shotgun for the shot used.

Instead of the ring I can use another embodiment featuring a square paper holder. This includes a top, two sides and a bottom member, support legs and clamps connecting the parts together.

It is thus an object of my invention to provide a portable holder for shotgun pattern paper which is easy to assemble.

Various objects and a better understanding of the invention can be had from the following description taken in conjunction with the drawings.

DETAILED DESCRIPTION OF THE PREFERRED EMBODIMENT

Figure 2:
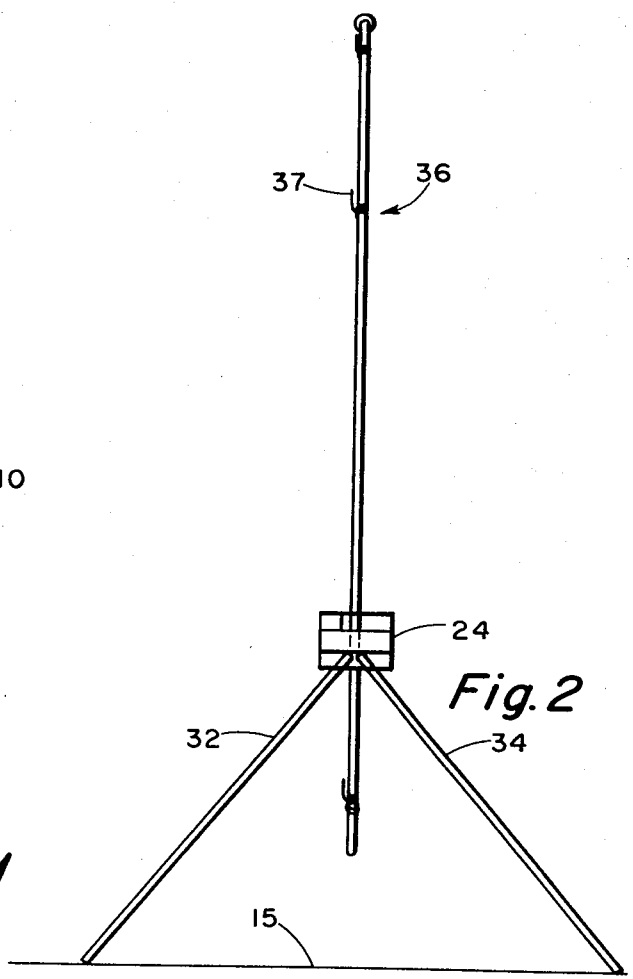
FIG. 2 is an end view of the holder of FIG. 1.
Figure 1:
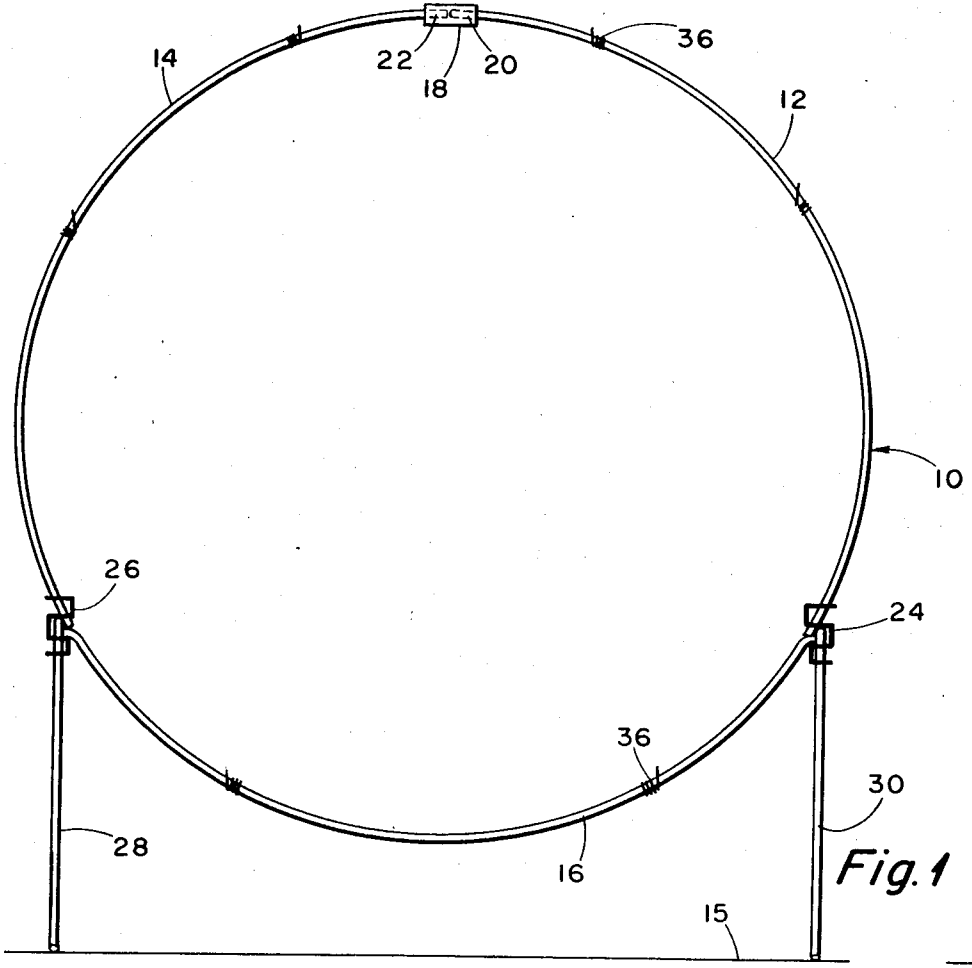
FIG. 1 shows a front view of my assembled holder for shotgun pattern paper.

Attention is first directed to FIGS. 1 and 2 which shows a portable pattern holder which includes a ring 10 which includes two upper loops 12 and 14 and a lower loop 16, each in the form of arcs preferably of less than 180° each. These loops can be small diameter rods such as 5/16" diameter and can be made from suitable material such as steel. The ends of loops 12 and 14 are merely a part of the arc i.e., they need not be bent. The upper ends of loops 12 and 14 are connected by a tubular clamp means 18 into which each end 20 and 22 of the upper loops can be inserted. The clamp is made to have friction fit with ends so that the upper loops will be maintained therein once they are forced in but the friction is small enough that they can be removed easily by hand. The lower end of loops 12 and 14 and both ends of the lower loop 16 are connected by a clamp means 24 and 26. If desired the lower ends of loops 12 and 14 may be welded to clamps 24 and 26 respectively. There is a left support means 28 and a right support means 30. Each of the support means comprise a first leg 32 and a second leg 34 as shown in FIG. 2. The configuration of the preferred form of clips 26 and 54 will be described in relation to FIGS. 4 and 5. Also shown in FIGS. 1 and 2 are pattern holding hooks or clips 36. There are shown six such clips in FIG. 1, although any practical number can be used. The clips are more clearly shown in FIG. 2 and can be attached to the loops in any desirable manner such as by welding or rigidly wrapping stiff heavy wire around the loops and having an upper prong 37.

Figure 3:
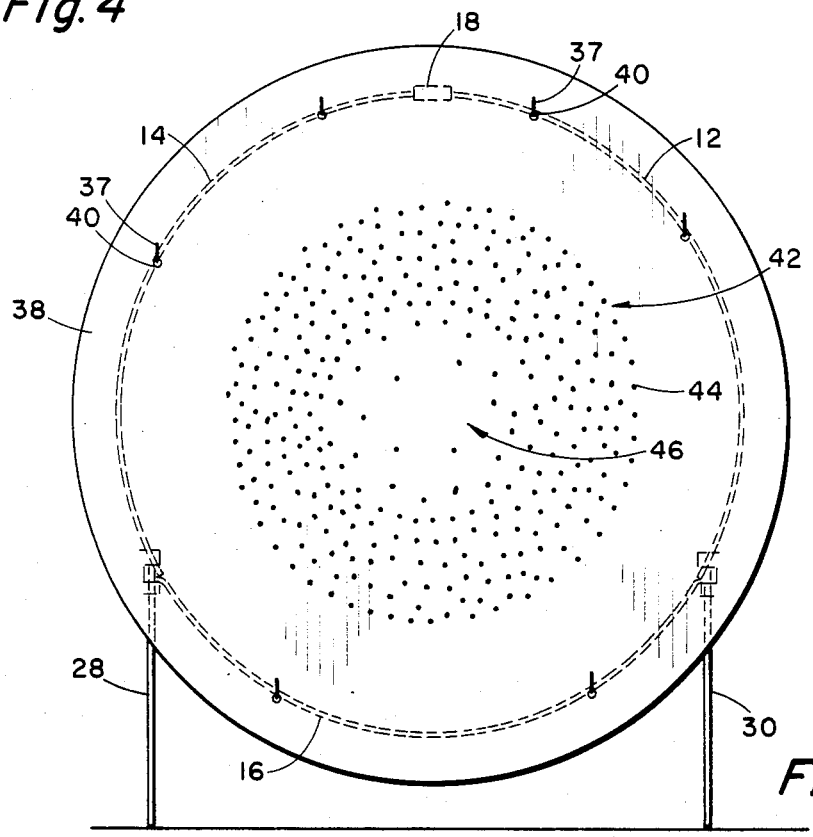
FIG. 3 illustrates the holder of FIG. 1 with pattern paper mounted thereon and shot pattern indicated.
Figure 6:
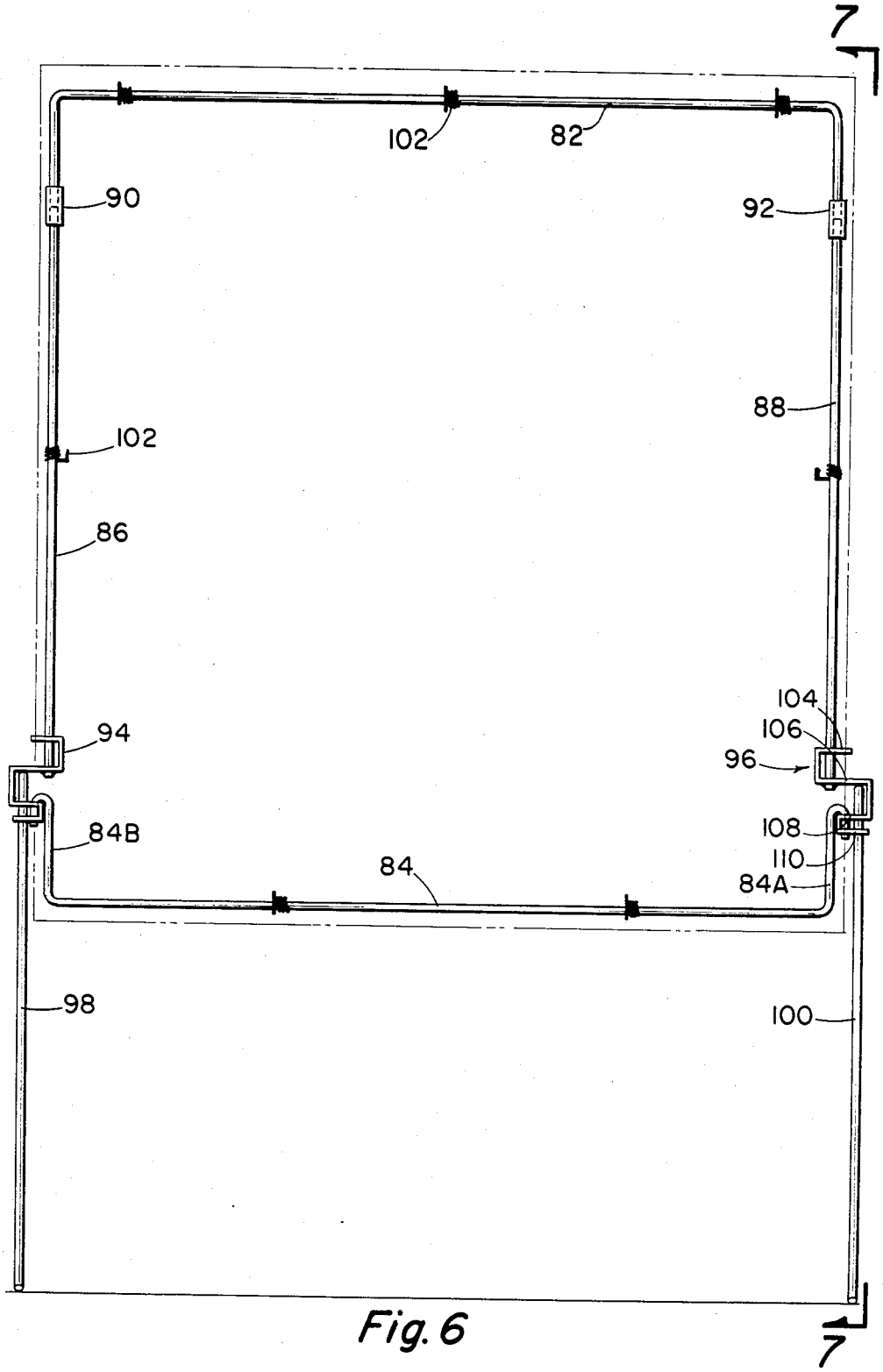
FIG. 6 shows a front view of another embodiment of my assembled holder for shotgun pattern paper.
Figure 7:
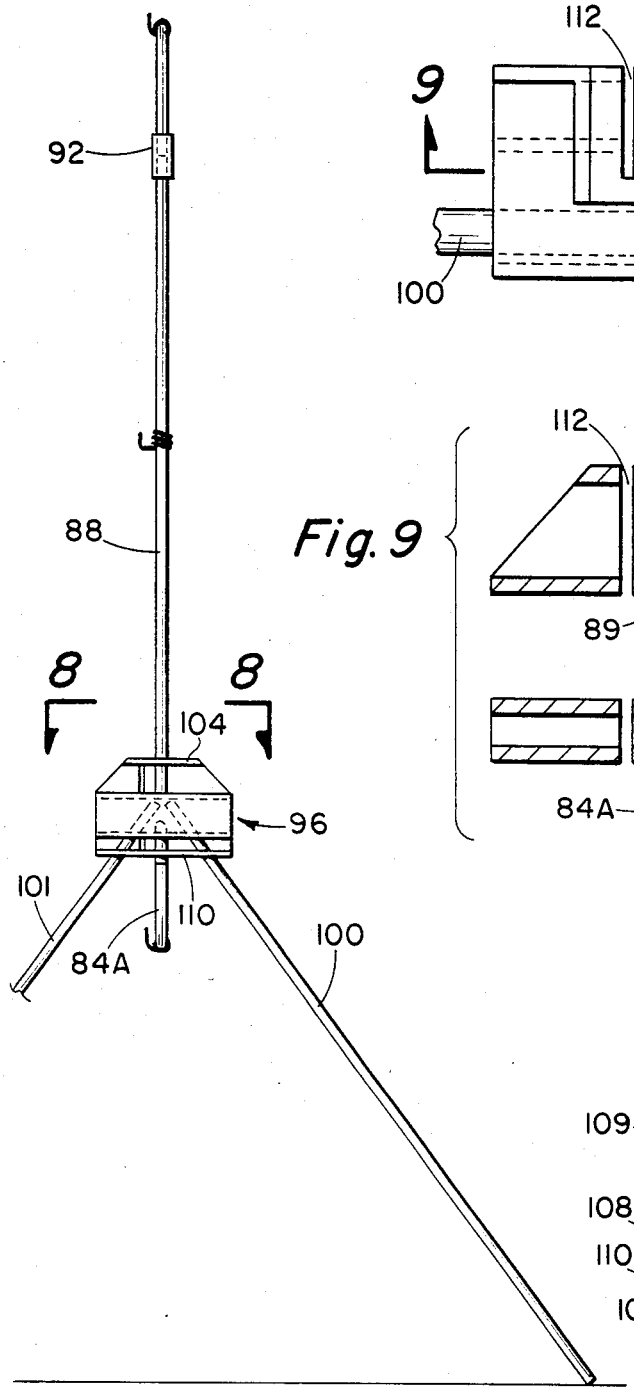
FIG. 7 is a view taken along the line 7—7 of FIG. 6.

Attention is next directed to FIG. 3 which shows pattern paper 38 which has a plurality of holes 40 which are arranged in the same pattern as are the hooks 36 shown in FIG. 1. Each projection 37 is inserted through its associated hole 40 and the paper is then placed in the position shown in FIG. 3. There is shown a shot pattern 42 comprising a plurality of individual shot holes 44. The arrangement of these holes show clearly that there is a void area 46 of shot holes in the center of the pattern. This would indicate to the shotgun owner that any target in the void area 46 might be missed by a shot with this pattern even though the aim for the target was perfect. Depending on the size of the target, it might be missed all together or it might have only very few shots therein.

Figure 4:
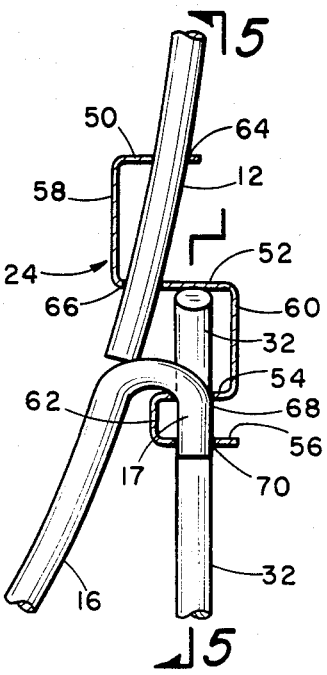
FIG. 4 illustrates one of the clamping means clamping the ring and legs together and is a view taken along the line 4—4 of FIG. 5.
Figure 5:
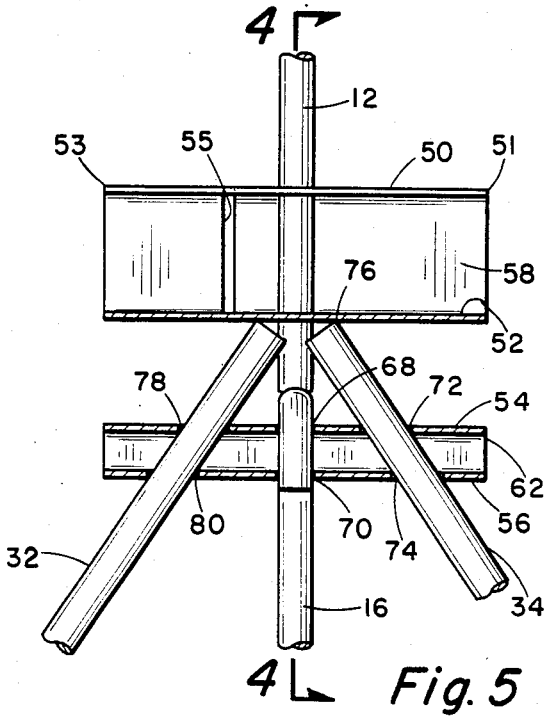
FIG. 5 is a view taken along the line 5—5 of FIG. 4.

Attention will now be directed to FIGS. 4 and 5 for a detailed description of the unique clamps 24 and 26 which are identical. Clamp 24 is comprised on one flat piece of metal rectangular in shape which has been bent at six right angles and drilled to form a clamp. The clamp material should be of a material which can be bent to the shape shown and have enough strenght and rigidity to maintain its shape while in use. It includes four horizontal sections 50, 52, 54 and 56 and three vertical sections 58, 60 and 62. Section 52 is of a slightly greater width than 50, 54 and 46. By width I mean the horizontal dimension of these sections 50, 52, 54 and 56 as shown in FIG. 4 and this width can be refered to as "A", "B", "C" and "D" respectively. By height I mean the vertical dimension of the sections 58, 60 and 62 also shown in FIG. 4 and the length can be referred to respectively as "E", "F" and "G". The cross-section of sections 50, 58 and 52 is U-shaped pattern as is the crosssection of sections 52, 60 and 54 and also sections 54, 60 and 56. The first and last mentioned U-shaped patterns face one direction and the middle one face the opposite direction. Sections 50 and 52 are provided with holes 64 and 66 which are slightly offset to permit the insertion of loop 12 of the ring of the pattern holder. Sections 54 and 56 are provided with center holes 68 and 70 respectively which are aligned and are for receiving hook 17 on the upper end of lower loop 16 of the ring pattern holder.

Sections 54 and 56 of the clamp 24 are provided with offset holes 72 and 74 so that the upper end 76 of leg 34 contacts section 52 near the center thereof. The left side of sections 54 and 56 are likewise provided with holes 78 and 80 which accomodate leg 32 in the same manner as that just described above for leg 34.

The assembly and disassembly of this device is very easy. To disassemble the device shown in FIGS. 1 and 2, I simply remove the lower ends of loops 12 and 14 from clamps 24 and 26 respectively and then remove the other ends from clamp 18. I then remove legs 30 and 34 from clamp 24 the other two legs from clamp 26. I also remove loop 16 from clamps 26 and 24. I then take all the disassembled parts and place them in a box or other suitable container. They can then be stored in the trunk of an automobile or any other suitable spot.

When it is desired to assemble the holder for the shotgun pattern paper, I remove the disassembled parts from their box or container. I first hook the hook ends of lower loop 16 through holes 68 and 70 of clamp 24 and similar holes in claim 26, then I insert legs 32 and 34 through the respective holes indicated in FIG. 5 and legs 28 through similar holes in claim 26. I then have the lower part of the pattern holder assembled where it will rest upon the ground 15. I next fasten loops 12 and 14 together with clamp 18 and then insert the lower ends of these two sections through holes 64 and 66 of the clamp 24 and also corresponding holes through clamp 26. I am now ready to put the pattern paper 38 thereon. This is easily done by inserting the projections 37 through holes 40 and just let the paper hang thereon. A paper slit 55 can be cut in the clamp as shown in FIG. 5 to let the paper hang more evenly and eliminate two hooks. I am now ready for firing a shotgun at the target to obtain the shot pattern.

A clamping means 24 which I have built and found very satisfactory, had the following dimensions. The width of section 50 was ½", and section 56 was ½". The width of section 52 was ¾", section 54 was ½", section 58 was ¾", section 60 was ¾" and section 62 was ¼". These dimensions are along the lines of the section shown in FIG. 4. The length of a section as shown in FIG. 5 from point 51 to point 53 was about 2". Holes 64 and 66 for the top loop and holes 68 and 70 for the bottom loop were ¼". Holes 72, 74, 78 and 80 for the legs were 5/16" in diameter. This clamp is easy to make and holds all the inserted parts securely together.

Attention is now directed to FIGS. 6 through 10 which show a different embodiment of my portable paper pattern holder which includes a square frame instead of a circular frame as shown above in FIGS. 1 through 5. Attention is especially directed to FIG. 6 which shows a square holder comprising a top bar 82, a bottom bar 84 having hooked segments 84A and 84B, and side bars 86 and 88. The side bars 86 and 88 are fastened to top bar 82 respectively by clamps 90 and 92 which may be simple friction clamps so that when the ends of the bars are inserted therein, they are held in position until forceably removed. Paper holder 102, which may be similar to paper holders 36, are also provided at appropriate spacings about the square holder.

Figure 8:
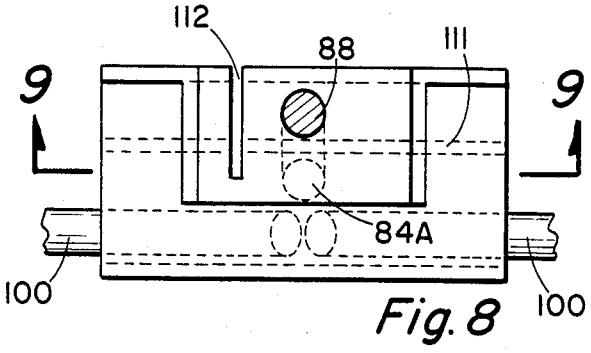
FIG. 8 is a view taken along the line 8—8 of FIG. 7.
Figure 9:
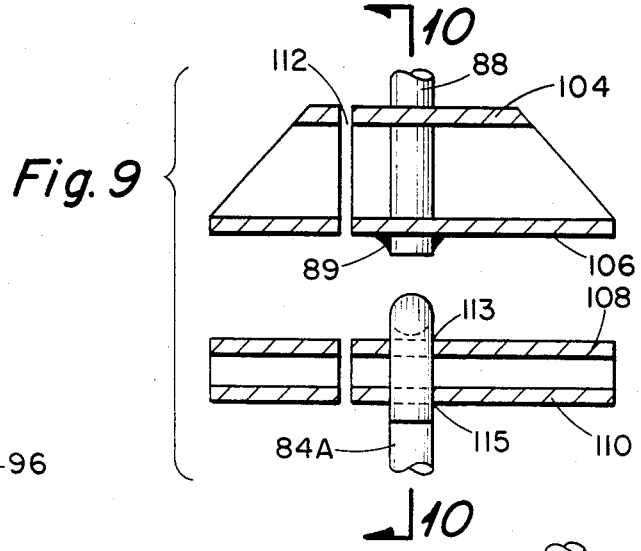
FIG. 9 is a view taken along the line 9—9 of FIG. 8.
Figure 10:
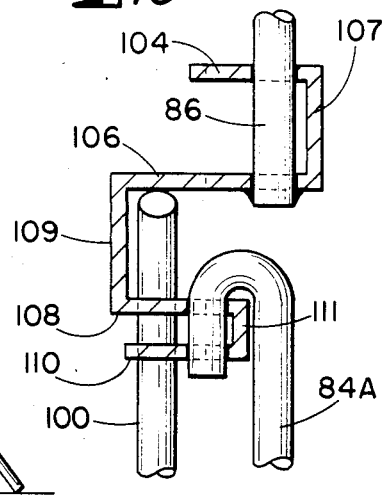
FIG. 10 is a view taken along the line 10—10 of FIG. 9.

Clamps 94 and 96 are essentially identical and are shown more clearly in FIGS. 8, 9 and 10. These clamps 94 and 96 are also similar to clamps 24 and 26 of FIGS. 1 to 5. The side bar or member 88 goes through upper section 104 and intermediate section 106 and is welded thereto at 89 as shown in FIG. 9. It is preferred that the side bars 88 be welded to the clamps 94 and 96, however, they can just be inserted as indicated above for the embodiment of FIGS. 1 through 5. Upright segment 84A of lower bar 84 hooks over and into holes 113 and 115 of sections 108 and 110 respectively as also shown in FIG. 9. Support legs 100 and 101 extend upwardly through holes in plates 110 and 108 similarly as do support legs 32 and 34 extend upwardly through plates 56 and 54 as shown in FIG. 5. As shown in the embodiment of FIG. 4, holes 64 and 66 in members 50 and 52 are not vertically aligned because of the arc of the upper segment. However, in the clamp of FIGS. 6 through 10, the holes 109 and 111 are vertically aligned. As clearly shown in FIGS. 8 and 9, there is a paper slot 112.

Section 104 of the clamp is connected to Section 106 by vertical section 107. Likewise, horizontal section 106 is connected to horizontal section 108 by vertical section 109 and horizontal section 108 is connected to horizontal section 110 by vertical section 111.

While this invention has been described with a certain degree of particularity, it is manifest than many changes may be made in the details of construction in the arrangement of components without departing from the spirit and scope of the disclosure. For example, the lower ends of loops 12 and 14 can be welded to clamps 24 and 26. It is understood that the invention is not limited to the embodiment set forth herein for purposes of exemplification, but is limited only by the scope of the attached claim or claims, including the full range of equivalency to which each element thereof is entitled.

What is claimed is:

1. A holder for shotgun pattern paper comprising:

a ring of two upper loops and one lower loop in the form of archs each upper loop having an upper end and a lower end and the lower loop having a hook at each end;

a top clamp for holding the upper ends of said two upper loops together;

leg means for supporting the holder above a surface;

two bottom clamps for receiving the lower ends of said two upper loops and the hooks on said lower loop and further holes for receiving said leg means.

2. A holder as defined in claim 1 including clips attached to said ring for holding said pattern paper.

3. A holder as defined in claim 2 in which said clips are stiff heavy wire wrapped at intervals about the ring with upwardly directed projections.

4. A holder as defined in claim 1 in which said bottom clamp includes a rectangular piece of metal which has been bent at six positions in the form of right angles with succeeding right angles being reversed from the prior angle so that there are four parallel Sections 50, 52, 54 and 56 in which Section 52 is of greater width than sections 50, 54 and 56, there being aligned holes through Sections 54 and 56 in the center thereof, one hole on either side of the center of Section 54 and one hole on each side of the center of Section 56, the holes being farther from the center than that in Section 54, and a hole in and intermediate the ends of Section 50 and Section 52.

5. A clamp made from a rectangular piece of material having dimensions X and Y and being folded by six right angles to form two U-shaped sections connected by a planear section, said first U-shaped section having a Leg A, and Leg B and the second U-shaped section having a Leg C and Leg D and in which B is greater in width than said Legs A, C and D, a first hole through said Section A, a second hole through said Section B, said holes aligned to receive one end of an arch shaped rod;

third and fourth holes through said Sections C and D respectively in the center thereof;

fifth and sixth holes through section C on either side of said third hole and seventh and eighth holes on either side of said fourth hole, said seventh and eighth holes being farther from said fourth hole than said holes five and six are from said third hole.

6. A holder for shotgun pattern paper comprising:

a ring of two upper loops and one lower loop in the form of arcs, each upper loop having an upper end and a lower end and the lower loop having two ends;

a top clamp for holding the upper ends of said two upper loops together;

leg rods;

two bottom clamps, each attachable to the lower end of one of said upper loops and to one end of said lower loop and to said leg rods.

7. A holder as defined in claim 6 in which each said bottom clamp is welded to the lower end of one of said upper loops.

8. A holder for shotgun pattern paper comprising:

a rectangular frame including an upper bar, a first side bar and a second side bar, a bottom section with a hook member at each end thereof;

a first and a second clamping means to clamp said top section to said side section respectively;

leg means for supporting the holder above a surface;

two bottom clamps for receiving the lower end of said two side bars and the hooks on said bottom bar and having holes for receiving said leg means.

9. A holder as defined in claim 8 including clips attached to said frame for holding said pattern paper.

10. A holder as defined in claim 8 in which each said bottom clamp includes a flat piece of metal having a center line and which has been bent at six lines perpendicular to said center line in the form of right angles with succeeding right angles being reversed from the prior angle so that there are four parallel sections 1 (104), 2 (106), 3 (108) and 4 (110) in which section 2 is of greater width (measured along said center line) than sections 1, 3 and 4, there are aligned holes through sections 3 ad 4 in the center line thereof, one hole on either side of the center line of section 3 and one hole on each side of the center line of section 4, the holes in section 4 being further from the center than those in section 3 and a hole in the center line of section 104 and section 106.

* * * * *